United States Patent [19]

Wortman

[11] 4,179,776

[45] Dec. 25, 1979

[54] METHOD AND APPARATUS FOR DEREGISTERING AND PROCESSING AN OPEN SYNTHETIC TOW INTO FIBER-FILLED ARTICLES

[76] Inventor: Harold Wortman, 5936 Monroe St., Morton Grove, Ill. 60053

[21] Appl. No.: 834,176

[22] Filed: Sep. 19, 1977

[51] Int. Cl.[2] ..... B65D 75/00; D04H 3/00; D02J 1/18

[52] U.S. Cl. ..... 28/121; 19/163; 28/158; 28/282; 28/283; 28/170

[58] Field of Search ..... 28/282, 283, 121, 158, 28/170; 19/163

[56] References Cited

U.S. PATENT DOCUMENTS

| | | | |
|---|---|---|---|
| 2,244,203 | 6/1941 | Kern | 28/282 |
| 3,032,829 | 5/1962 | Mahoney et al. | 28/282 X |
| 3,095,632 | 7/1963 | Smith | 28/282 |
| 3,156,016 | 11/1964 | Dunlap et al. | 28/282 X |
| 3,222,730 | 12/1965 | Kalwaites | 19/163 |
| 3,351,992 | 11/1967 | Carter | 19/160 |
| 3,501,811 | 3/1970 | Watson | 28/282 X |
| 3,523,059 | 8/1970 | Coates | 28/121 X |
| 3,708,832 | 1/1973 | Lohrke | 28/282 |
| 3,737,950 | 6/1973 | Bolliand et al. | 28/282 |
| 3,819,469 | 6/1974 | Balch et al. | 28/282 X |
| 3,903,569 | 9/1975 | Brandis | 19/163 |

FOREIGN PATENT DOCUMENTS

| | | | |
|---|---|---|---|
| 1575345 | 7/1969 | France | 28/282 |
| 930543 | 7/1963 | United Kingdom | 19/163 |

*Primary Examiner*—Robert Mackey
*Attorney, Agent, or Firm*—Alter and Weiss

[57] ABSTRACT

An improved method for producing and processing deregistered and disorientated synthetic tow for forming fiber filled articles in which crimped registered tow is deregistered through pairs of rolls utilizing a non-continuous groove-threaded surface. The synthetic tow is dispersed and spread, and collected for continuous distribution into and envelopment by article surface material. The automatic process and apparatus associated therewith additionally form and finish the fiber filled articles themselves for additional fabrication processes or for use as is. Vacuum suction and reciprocating distribution of the open tow web may be varied as desired to arrive at particular article thicknesses directed towards particular article uses.

11 Claims, 7 Drawing Figures

METHOD AND APPARATUS FOR DEREGISTERING AND PROCESSING AN OPEN SYNTHETIC TOW INTO FIBER-FILLED ARTICLES

BACKGROUND OF THE INVENTION

The present invention relates in general to fabricated fiber-filled articles and in particular to an improved method and apparatus for producing and processing a deregistered open synthetic tow for inclusion into such fiber-filled articles.

Quilted articles, such as sleeping bags, jackets, bedspreads and the like have, throughout history, been used for the warmth and comfort characteristics which are imparted to a user. While materials might vary, most quilted articles are comprised of a plurality of quilt encompassing materials and a filler material sandwiched between these encompassing materials, which provide increased insulation and comfort. While virtually many materials can and have been used as quilt encompassing materials, most quilted articles have filler materials made of down or natural or synthetic bulk fibers.

Synthetic tow which is provided for use in the state of a crimped registered tow bundle has most recently been utilized as an inexpensive and effective filling for such articles. In order to use such a synthetic fiber product it has been necessary to open, deregister or disorientate the substantially narrow, crimped raw material before the relatively fluffy open tow web or bundle is inserted into a fiber-filled article.

At present, the process for opening such tow involves the utilization of two or more pairs of rollers with a standard continuously-threaded corrugated roll. This roll, in combination with another meeting roll draws the synthetic tow from a pair of rolls rotating at a substantially lower rate of speed to place tension upon the tow while simultaneously "combing" the tow to deregister it. This often requires the threaded rolls to be rotating approximately 2 to 3 times the speed that the preliminary pair of rolls is moving and often results in many of the fibers slipping through the continuous grooves on the roller itself. This poses a problem in that, while the majority of fibers are stretched and combed and thus opened through this process, several of the fibers nonetheless miss the deregistration process due to the failure of these fibers to actually make contact with the raised tooth portions of the corrugated roll. To compensate for this inadequacy of the conventional tow opening process, speed ratios must be maintained at a substantially high amount, often causing the problem of over stretching of the fibers which are processed through the corrugated roll. When such fibers are overstretched, the heating processes associated with washing and drying of the article could cause deformation of the article itself when the fibers tend to return to their original unstretched shape resulting in puckering and uneven flow of the fiber filling within the article. This problem is often termed "memory shrinkage".

Additionally, few, if any, of the existing conventional methods and apparatus address themselves to the processes necessary for the entire fabrication of the article once the tow is opened and deregistered. Accordingly, while a substantially automated efficient process is directed toward the opening of the tow, the collection, distribution, and envelopment of the resulting tow web product is left to inefficient manual fabrication techniques which simply fail to produce a high quality, standardized, fabricated article at a substantially reasonable cost.

It is thus the object of the present invention to provide a process and apparatus for opening and deregistering crimped synthetic tow which does so in a more effective manner to yield an open tow product of improved density while at the same time having more stable non-deforming wear characteristics. In accordance with this object, it is an additional object to intermittently hold and release a group of fibers as they are being stretched and deregistered between two pairs of rotating rollers, and to maximize the volume of fibers exposed to this process.

It is also an object of the present invention to provide for the fabrication of such an open tow without requiring excessively high speed machinery while at the same time producing an open tow synthetic product having improved insulation and comfort features inexpensively and in a more facilitated manner.

Further, it is an object of the present invention to provide a process and apparatus through which the entire fiber filled article itself may be fabricated through the utilization of automated techniques for the express purposes of providing a consistant high quality product at substantially reduced cost and in a facilitated manner.

Similarly, it is an object of the present invention to provide a method and apparatus through which various thicknesses of fiber filling may be obtained with relative ease depending upon the objectives and utilization of the end product itself.

These and other objects will become apparent in light of the present specification.

SUMMARY OF THE INVENTION

The present invention comprises an improved method and apparatus for producing and processing deregistered and disorientated synthetic tow for inclusion into fiber-filled articles. The method through which such synthetic tow is opened comprises the steps of feeding a substantially narrow crimped registered tow bundle into the nip formed between a first pair of rolls. Each one of the first pair of rolls rotates oppositely to one another at a first speed so as to draw the tow bundle through and between the rolls. One or more of each of the rolls comprising this first pair has smooth surfaces. The tow is deregistered by drawing the tow bundle from the back side of the first pair of rolls into the nip of a second pair of rolls equivalently rotating oppositely to one another, at a second speed greater than the speed of the first pair of rolls. One or more of each of the rolls in this second pair of rolls has a smooth surface and one or more of the second pair of rolls utilizes a noncontinuous groove-threaded surface. As the web is deregistered between the two pairs of rolls, it is also spread outwardly to a width substantially greater than that of the entering narrow crimped registered tow bundle. The two is then additionally dispersed and spread as it is processed at a position before or after the first and second pairs of rolls thereby additionally shaping the tow into a substantially dispersed web. The web is then collected for distribution into one or more fiber-filled articles.

The preferred embodiment of the invention includes distributing the web for envelopment into the fiber-filled articles. The web is preliminarily enveloped between a plurality of article surface materials, and the enveloped or sandwiched web is finished by enclosing and affixing the enveloped web between this plurality of article surface materials through the utilization of article attachment means.

In the preferred embodiment of the invention, the second pair of rolls includes one roll which has a noncontinuous groove-threaded surface. This roll is substantially cylindrical and has fabricated thereon a plurality of staggered thread teeth. Each of these staggered thread teeth has a substantially thick mid-portion tapering to narrower end portions, and the staggered teeth are positioned in rows along the circumference of the cylindrical roll. The staggered thread teeth draw the bundles of synthetic tow undergoing disorientation to alternatively place the bundles of tow fibers under tension and relaxation while the tow passes between the second pair of rolls. As contact is made between the fibers and the ridges of the teeth, the fibers are placed under tension, and the fibers are released when they enter a portion of the roll in which spaces occur between the teeth. In this particular embodiment, each of these plurality of staggered thread teeth radiates substantially normal to the axis of the roll to cover approximately one-fourth the circumference of the roll in each row thereby providing a single repeat tooth pattern on the roll. In the staggered tooth embodiment, the greater the lead angle between the teeth, the wider the angle of contact of the filament against the roll for a more positive contact with the tow. This feature minimizes the possibility of tow fibers missing a raised tooth portion for deregistration thereby as these fibers pass along the roller surface. Additionally, the greater the lead angle between the teeth, the more substantial will be the outward spreading of the web after it emerges from the second pair of rolls.

In another embodiment of the invention, the second pair of rolls includes one roll which also has a noncontinuous groove-threaded surface formed onto a substantially cylindrical roll. This cylindrical roll has fabricated therein, a plurality of connected thread teeth positioned therealong in curvilinear herringbone pattern utilizing a first and second opposing pitch. In this particular embodiment, each of the first and second opposing pitches extends for one-half the circumference of the roll before the successive change in pitch is encountered. As in the staggered thread tooth embodiment, this curvilinear herringbone tooth pattern alternatively draws the bundles of tow in tension and releases these bundles of tow, while the tow is passed between the second pair of rolls. As the continuous group of filaments in the tow contacts the angled tooth, they are drawn in tension for release when the fibers are proximate to the spaces between equivalent adjacent tooth ridges.

In the preferred embodiment of the invention also, the peripheries of each of the second pair of rolls rotate at a velocity ranging substantially between 1¼ to 2 times the velocity of the peripheries of each of the first pair of rolls. For example, the peripheral velocity of each of the second pair of rolls would rotate in the range of from 60 to 120 feet per minute while the velocity of each of the first pair of rolls ranges from 50 to 70 feet per minute.

Additionally, each of the rolls, respectively, meet one another under exerted pressure. Thus, each of the rolls forming the first pair of rolls meet under pressure and each of the rolls of the second pair of rolls meet under pressure. In the preferred embodiment, the pressure between each of the rolls comprising the first pair of rolls is substantially 60 pounds per square inch while the pressure between each of the rolls of the second pair of rolls is substantially 30 pounds per square inch. Thus, in this preferred embodiment, the pressure ratio of the first pair of rolls relative to the second pair of rolls is substantially 2 to 1.

Dispersing and spreading of the tow is accomplished through guiding the tow through a plurality of dispersion devices. One or more of these dispersion devices utilize air directed through angularly positioned slits to direct the fibers of the tow outwardly so as to form the substantially dispersed web. In an alternative embodiment, additional pairs of rolls having at least one roll with a noncontinuous groove-threaded surface may be used to assist in dispersing and spreading the tow. Thus, this dispersion and spreading need not rely upon air blowing devices but may rather utilize the tow spreading technique obtained through the second pair of rolls.

In the preferred embodiment of the invention, one of the dispersing devices is positioned immediately before the nip formed between the two rolls making up the first pair of of rolls. Through such an arrangement, the web is dispersed immediately before the deregistration process in which tension and relaxation are exerted through the utilization of two pairs of rolls. Additionally, the first and second pairs of rolls are closely positioned to one another in order to minimize width shrinkage and contraction of the overall web as it passes between the first and second pairs of rolls in the deregistration process. For example, as the second pair of rolls draws the web through and between its individual rollers, it exerts a tensive strength on the web of tow. Such a tensive strength has the effect, often, of undesirably contracting the width of the tow as it passes from the first pair of rolls to the second pair of rolls. With the two pairs of rolls positioned closely proximate to one another, this amount of undesirable contraction of the web width is minimized. This results in the maximization of the deregistered tow width emanating from the back side of the second pair of rolls which, optimally, should be substantially wide and dispersed having been deregistered between the two pairs of rolls.

The collecting operation through which the dispersed and spread web is collected for distribution into the filled articles is accomplished through collecting means positioned substantially after the first and second pairs of rolls. These collecting means comprise a third pair of rolls which, equivalently, has each roll rotating oppositely to one another so as to form a nip into which the web is directed and guided. This third pair of rolls reciprocates as a unit through reciprocation means so as to deposit the deregistered and disorientated synthetic tow web into means for preliminarily enveloping this same web.

The reciprocation means utilized for such a function comprises an integrated carriage assembly into which the third pair of rolls is restrainably positioned. Hydraulic motor means comprising a piston assembly having one end securely and restrainably positioned, and a second end attached to the carriage assembly, moves the carriage assembly back and forth in a reciprocating manner longitudinally, relative to the first and second pairs of rolls. Roll activation means for rotating one or more of the third pair of rolls in a constant rotational direction are utilized as the carriage reciprocates between the two linear directions. The rotation of the roll activation means thus corresponds to and is a function of the reciprocating movement of the piston assembly and in turn the reciprocating movement of the carriage assembly.

In the preferred embodiment of the invention, the roll activation means comprises rack means on either side of each of the third pair of rolls. Pinion gear means are located on each of the rolls in this third pair of rolls with each of the two rolls having a pinion gear means operably positioned in the rack, in a position opposite to one another. Thus, a first pinion gear is located on one side of the first of the two rolls and a second pinion gear is located on the opposite non-aligned side of the second of the two rolls, with each of the pinion gears located in oppositely facing racks. Ratchet means are operably connected with each of the pinion gear means. The ratchet means in the pinion gear in the first of the two rolls rotates this first roll which in turn rotates the second roll as the piston guides the carriage assembly in a first of two reciprocal directions. At the same time, the ratchet means in the pinion gear of the second roll becomes disengaged from the second roll as the carriage is directed in this first direction.

Alternatively, the ratchet means and pinion gear in the second roll rotate the second roll which in turn rotates the first roll as the piston guides the carriage assembly in a second of the two reciprocal directions. As the carriage proceeds in this direction, the ratchet means in the pinion gear attached to the first roll becomes disengaged. Through such an arrangement, the ratchet means cooperates with the pinion gear means and the rack means in each of the respective rolls of the third pair of rolls, to enable alternative rotation of the third pair of rolls by one of the first or second rolls depending upon the direction into which the carriage means is guided by the piston means. Through such an arrangement, additionally, it should be noted that no matter which direction the piston is prompting the carriage means, the rotational direction of the two rolls making up the third pair of rolls remains constant so that the web being guided therebetween is constantly prompted downwardly for the enveloping operation.

The enveloping operation is accomplished through the steps of depositing the collected web material onto a first layer of article surface material and by guiding this first layer of surface material with the deposited tow web into communication with a second layer of article surface material. This operation sandwiches the tow web between the first and second layers of surface material. This sandwiched web and surface material is then guided into means for finishing the fabrication of the articles, for affixing the positions of the first and second layers relative to one another, and for affixedly and restrainably enclosing the deposited tow web between the first and second layers of surface material. The enveloping of the web is further accomplished through the step of attracting the deposited web into close compacted position as desired on the first layer of article surface material through the utilization of vacuum suction means located below the first layer of article surface material as the web is deposited thereonto.

From the enveloping operation, the sandwiched tow and surface layer materials are finished into a fabricated article through the steps of crimping the web and first and second layers of surface materials together. These layers of article surface material are then attached to one another by material attachment means to form the article and to envelope the sandwiched tow web as desired, and the resulting sandwiched material is cut from the continuous sandwiched web as desired for further treatment or for direct incorporation into a fiber-filled article. In the preferred embodiment of the invention, the material attachment means comprises the stitching and sewing of the sandwiched web and surface layer materials surrounding same.

DETAILED DESCRIPTION

Figures 1, 2:
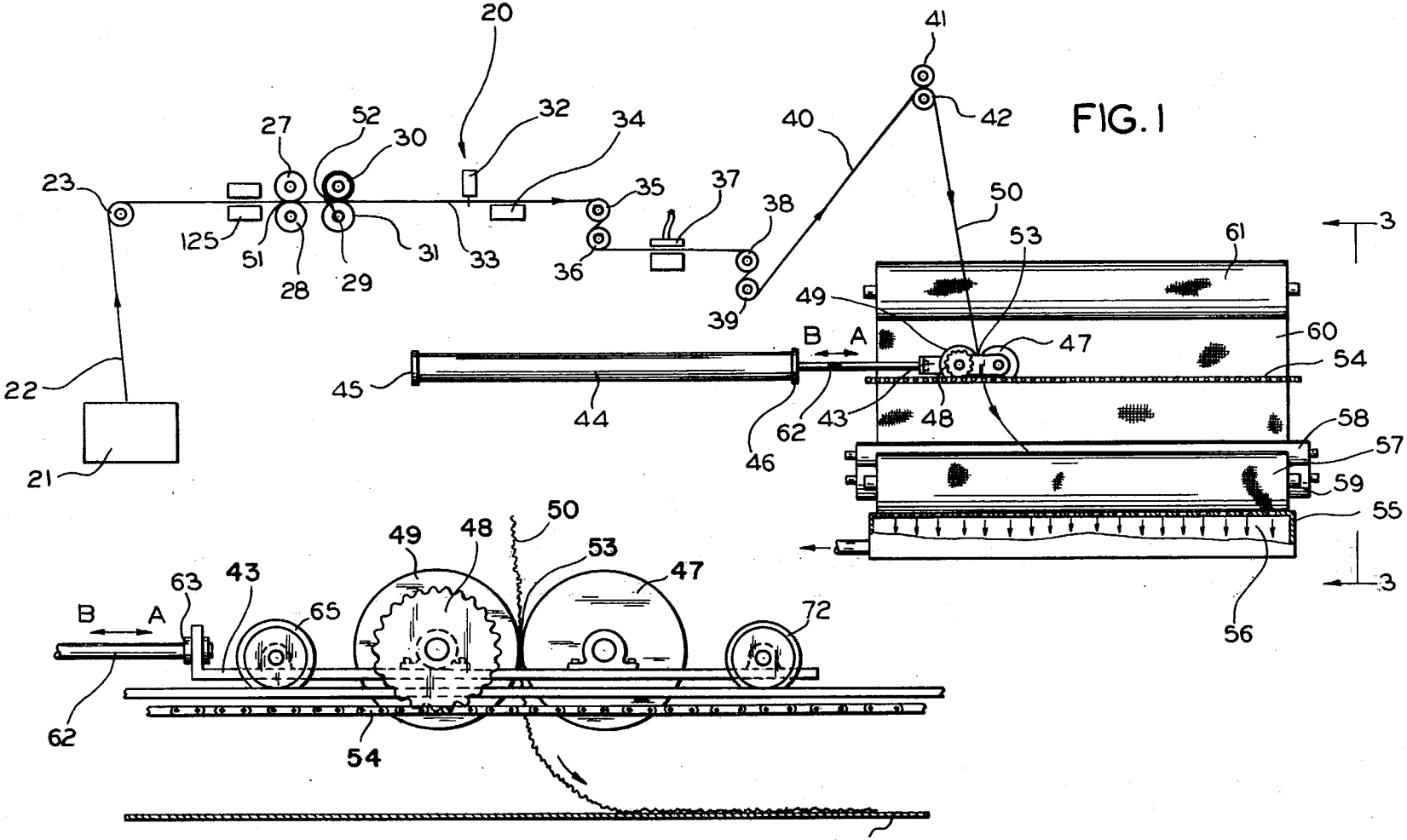
FIG. 1 of the drawings is a schematic side view illustrating the fabrication processes used in order to deregister and disorientate synthetic tow which further shows, in side elevational view the means for dispersing, spreading, collecting, distributing and enveloping the web of tow.
FIG. 2 is a side elevational view of the carriage assembly and its associated third pair of rolls used to distribute the opened, deregistered tow onto article surface materials.

While this invention is susceptible of many different forms, there is shown in the drawings and will herein be described in detail, several specific embodiments, with the understanding that the present disclosure is to be considered as an exemplification of the principles of the invention and is not intended to limit the invention to the embodiments illustrated.

The method and apparatus 20 utilized in producing and processing the deregistered and disorientated synthetic tow for inclusion into fiber-filled articles is shown schematically in FIG. 1. Crimped registered tow 22 is fed from carton 21 to pulley 23 after which it is acted on by dispersion blower 125 which spreads the narrow tow outwardly immediately before the deregistration process imposed by the two pairs of rolls 27-28 and 30-31. The tow passes through first pair of rolls 27-28 which, in the preferred embodiment have smooth continuous surfaces on their peripheries. Nip 51 is formed between rollers 27 and 28 and these two rollers are maintained against one another under pressure and are also maintained at a particular peripheral rotating speed. Web 29 is then fed into nip 52 formed between second pair of rolls 30-31 which is preferably positioned closely next to the first pair of rolls 27-28 to reduce width shrinkage in the tow as it passes under tension between the two pairs of rolls. The two is not only deregistered between the first and second pairs of rolls, but is also spread outwardly to form a substantially wider tow bundle. In the preferred embodiment of the invention, roll 30 has a non-continuous groove-threaded surface which more effectively opens up and disorientates tow bundle 29 than conventional continuous threaded rolls in utilization. Second pair of rolls 30-31 rotate at their peripheries approximately one-and-a-quarter to two times the speed of the first pair of rolls so as to place tension upon tow bundle fibers 29. Further, rolls 30 and 31 meet each other under an exerted pressure substantially one-half of the pressure between rolls 27 and 28 in the first pair of rolls, to more effectively dislodge the crimped fiber arrangement without stretching the fiber tow beyond its limit of elasticity, while avoiding the losing of the crimp within the fiber tow. Such an arrangement avoids the over-stretching of the tow to avoid the detriment associated with over-stretched fibers which could spring back radically during the washing and drying processes and which thus could misshape the fiber-filled article. Destaticizer 32 works upon open deregistered tow 33 before it passes through dispersing blower 34, idlers 35 and 36, dispersing blower 37 and idlers 38 and 39; before the completely open tow 40 passes through feeder rolls 41 and 42 for distribution into the enveloping process. It should be noted that dispersing blower 34 is preferably uncontained on its top side to more-effectively dislodge contaminants from the tow bundle while further dispersing the filaments from one another. Further, idler roll pairs 35-36, 38-39 and/or 41-42 may utilize a construction equivalent to the "second" pair of rolls in which at least one of said idler rolls utilizes a noncontinuous groove threaded surface to further deregister the tow bundle.

From rolls 41 and 42, open tow 50 then passes through the nip 53 of third pair of rollers 49-47 for distribution onto the moving article surface material dispensed from bolt 57. Through the utilization of hydraulic cylinder 44 restrainably positioned at end 45 and attached to carriage assembly 43 through piston arm 62, web 50 is reciprocally moved back and forth and layered to the desired degree while pinion gear means such as gear 48 rotates the rollers inwardly towards nip 53 by rotating in rack 54 as piston arm 62 is extended and withdrawn. Vacuum means 55 assist in the appropriate layering of web 50 atop the article surface material and a second layer of article surface material 60 dispensed from bolt 61 is continuously applied to the deposited tow moving on top of the lower layer of article surface material for further processing.

An enlarged view of the carriage assembly 43 is shown in FIG. 2, connected for movement in either direction B or direction A as a function of the displacement of piston arm 62 connected at bolt 63. Rolls 49 and 47 rotate clockwise and counter-clockwise, respectively, to form nip 53 for distributing web 50 onto moving article surface material 71. Guide rollers 65 and 72 assist in the stability and guidance of the entire carriage assembly. The rotation of rolls 49 and 47 is obtained through a ratchet-gear arrangement as shown by pinion gear 48 positioned in rack 54. As carriage 43 is moved in direction A, gear 48 turns roller 49 clockwise which, in turn, rotates cylinder 47 counterclockwise to deposit the material web 50 downwardly onto surface material 71. Alternatively, when carriage 43 is moved in direction B, the ratchet means between gear 48 and roller 49 disengages the gear-rack rotation activation and frees roll 49 for rotation while an equivalent gear-ratchet assembly on the other side of roll 47 takes over rotational operation to rotate roll 47 counter-clockwise to in turn rotate roll 49 in a clockwise fashion. Accordingly, no matter which way the carriage is moving, through such an arrangement, the rolls are maintained in a constant rotational direction to consistently layer the distributed tow onto the moving article surface material. Additionally, differing layer patterns capable of controlling the amount of distributed tow deposited onto the surface material 71 may be obtained by simply altering the size of gear 48 which in turn alters the amount of rotation of cylindrical rolls 49 and 47 as a function of distance through which it is drawn in either direction A or B, by piston arm 62.

Figure 3:
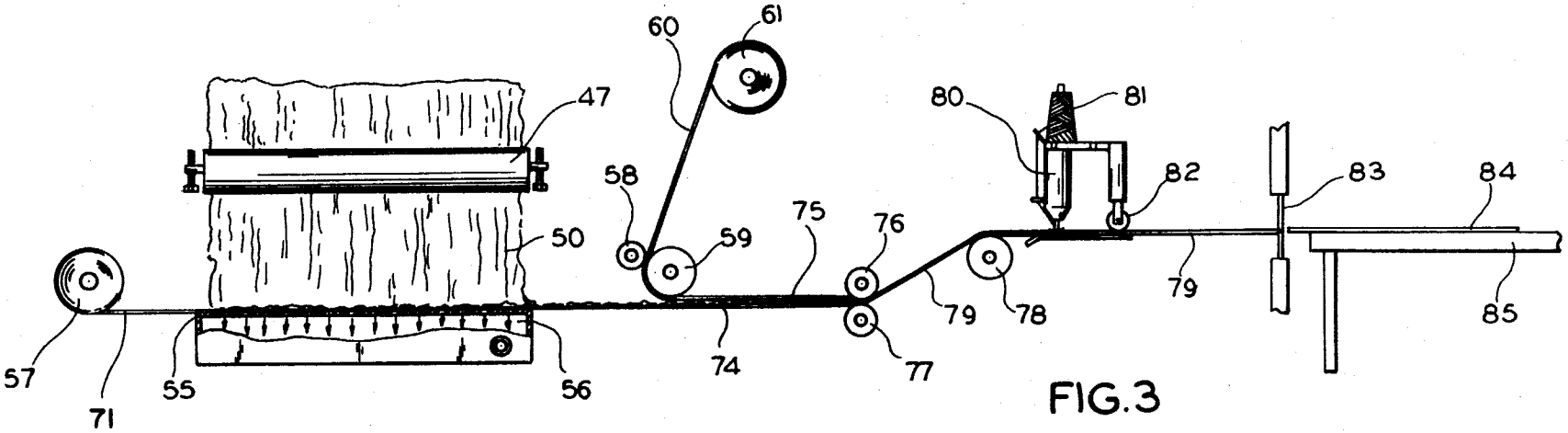
FIG. 3 is a front elevational schematic view of the invention illustrating particularly the distributing, enveloping and finishing processes associated with the production and processing of the two into a fiber filled article.

The process continues as shown in FIG. 3 in which bolt 57 dispensing the bottom layer of surface material 71 moves in a position substantially normal to the distributed web 50 being deposited by the rolls of the third pair, such as roll 47. As is shown, vacuum surface 55 and suction holes 56 positioned directly beneath article surface material 71 help draw the deposited and layered web material 50 into proper compactness atop surface material 71. A second surface material 60 forming the upper layer of the sandwich tow article 75 is distributed from bolt 61 through rollers 58 and 59 so as to juxtapose the upper surface material onto the deposited tow web and the lower layer surface material 71. The sandwiched article is then compressed at rollers 76 and 77 to form sandwiched article 79 which passes over roller 78 into the finishing operations shown by sewing and pinching apparatuses 80 and 82 and cutting apparatus 83. Finished article 84 is then shown deposited upon surface 85 for either further fabrication operations or for use as is as a fiber-filled article.

Figure 4:
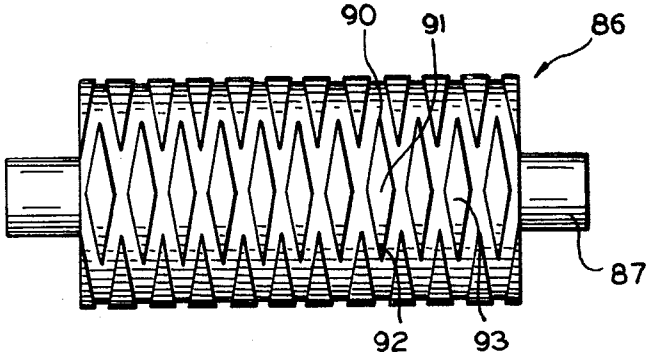
FIG. 4 is a front elevational view of one embodiment of the non-continuous groove-threaded surface of one of the rollers of the second pair of rollers showing particularly its staggered tooth arrangement.

FIG. 4 shows one embodiment of the non-continuous groove-threaded roll utilized in the second pair of rolls. In this particular embodiment, separate, non-connected thread teeth such as 91 and 93 are shown with tooth 91 having narrow ends 90 and 92. On cylindrical roll 86, the staggered teeth radiate substantially normal to the axis of the roll to cover substantially one-quarter the circumference of the roll to provide a single repeat tooth pattern on the roll.

Figure 5:
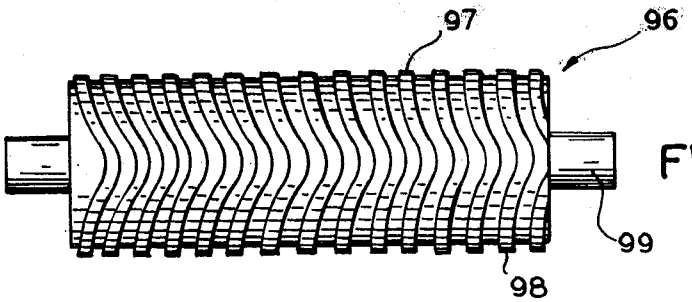
FIGS. 5 and 6 are front elevational views of another embodiment of the non-continuous groove-threaded surface utilized in the second pair of rolls, particularly showing the curvilinear herringbone pattern of threads at 90° intervals.
Figure 6:
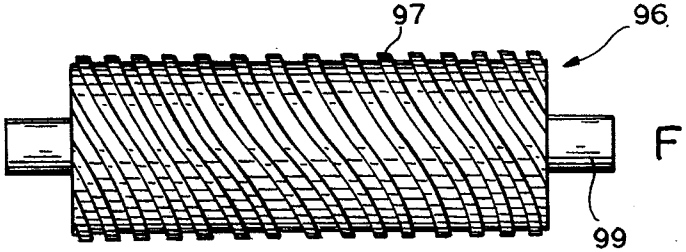

The curvilinear herringbone pattern of cylindrical roll 96 is shown in FIGS. 5 and 6 at 90° intervals, respectively, to illustrate the double pitch arrangement fabricated thereon. Different positions of tooth 97 along a first pitch and 98 along the second pitch are shown therein. The non-continuous nature of these two embodiments of rollers provide for improved tow opening features and minimizes the number of threads being processed that can slip through an open groove, while, at the same time, reducing the need for increased speed ratios of rotation between the first and second pairs of rolls and the pressures associated therebetween.

Figure 7:
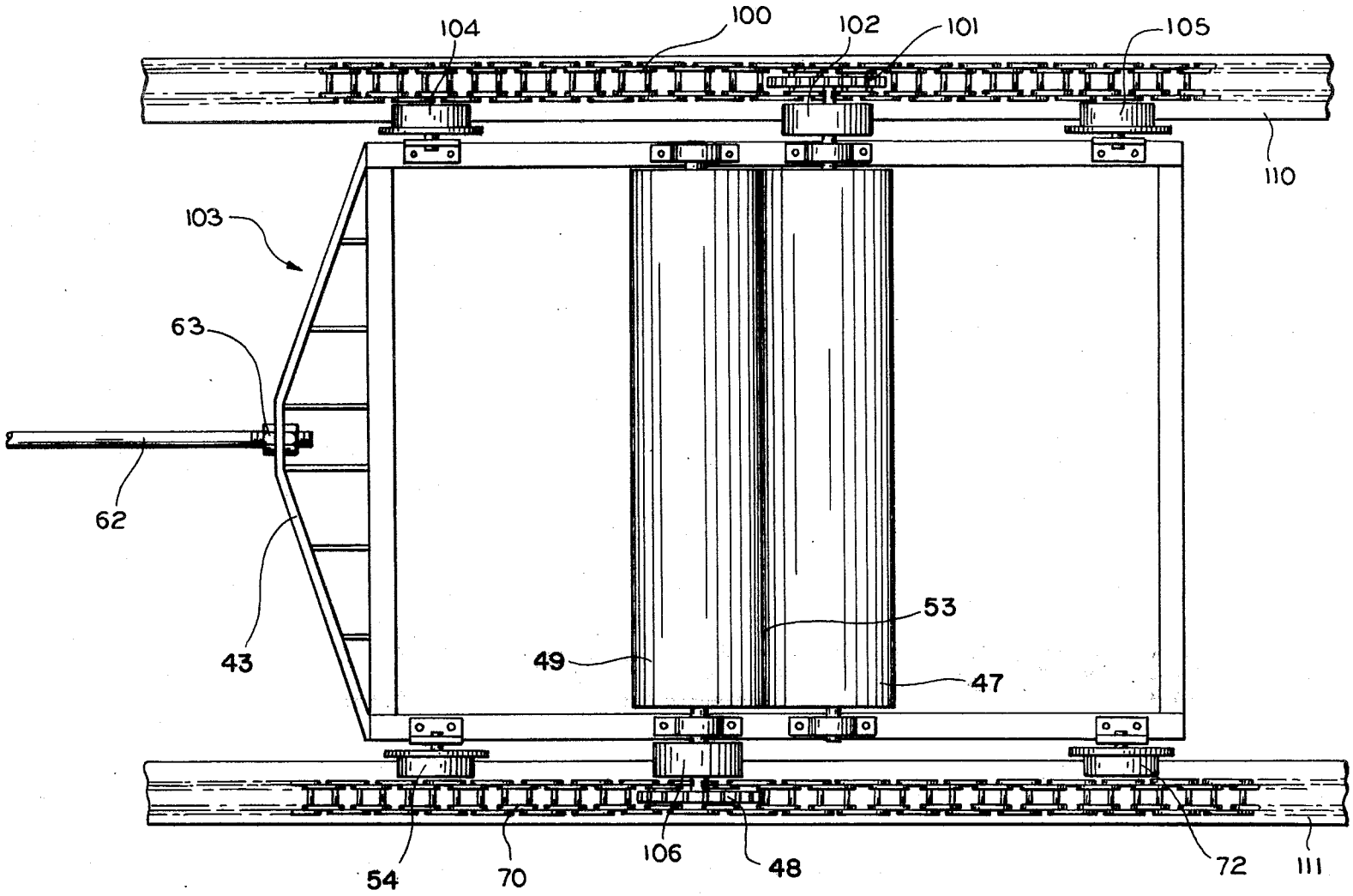
FIG. 7 is a top plan view of the carriage assembly showing particularly cooperation between the third pair of rolls, ratchet means, gear means and rack means utilized therein for distribution of the web of deregistered synthetic tow for envelopment into fiber filled articles.

Carriage assembly 43 is shown in FIG. 7 connected to piston rod 62 at bolt 63. Guiding rollers 65-72 and 104-105 on rails 111 and 110, respectively, maintain the stability of the carriage assembly 43 during reciprocal movement. Also shown in FIG. 7 is the arrangement in which gear 48 and ratchet means 106, operably attached to roll 49, activates rotation as the assembly is pushed to the right and releases as the assembly is pulled by piston rod 62 to the left. Alternatively, ratchet means 101 and ratchet assembly 102 rotate roll 47 as the assembly is pulled to the left to, in turn, rotate the free rolling cylinder 49 to maintain constant directional rotation of the roll for distributing the web of tow.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What I claim is:

1. An improved method for producing and processing deregistered and disorientated synthetic tow for inclusion into fiber filled articles, said method comprising the steps of:

A. Feeding a substantially narrow crimped registered tow bundle into a nip formed between a first pair of rolls, each one of said first pair of rolls rotating oppositely to one another at a first speed so as to draw said tow bundle through and between said rolls, at least one of said first pair of rolls having smooth surfaces;

B. Deregistering said crimped registered tow by drawing said tow bundle from the back side of said first pair of rolls into a nip of a second pair of rolls, each one of said second pair of rolls rotating oppositely to one another at a second speed greater than said first speed, at least one of said second pair of rolls having a noncontinuous groove-threaded surface, thereby spreading the tow bundle outwardly into a wider configuration;

C. Dispersing and spreading said tow as it is processed at a position proximate to said first and second pair of rolls thereby additionally shaping said tow into a substantially dispersed web;

D. Collecting said dispersed and spread web for distribution into said fiber filled articles;

E. Distributing said web of disorientated and deregistered synthetic tow for envelopment into said fiber filled article;

F. Preliminarily enveloping said web of disorientated and deregistered synthetic tow between a plurality of article surface materials, said enveloping being accomplished through the steps of:

1. Depositing said collected web material directly onto the first layer of article surface material by cross-lapping said web material in a reciprocating motion onto said first layer of material as said first layer of material is drawn in a direction substantially normal to the direction of said reciprocating motion;

2. Attracting said deposited web into close compacted position on said first layer of surface material through vacuum suction means located directly below said first layer of article surface material;

3. Guiding said first layer of surface material and said deposited tow web in said direction into communication with a second layer of article surface material thereby sandwiching said tow web between said first and second layers of surface material; and 4. Guiding said sandwiched web and surface materials into means for attaching said first and second layers to one another for enclosing said deposited tow web between said first and second layers of surface material; and G. Finishing the fabrication of said fiber filled articles by enclosing and affixing said enveloped web between said plurality of article surface materials through the use of article attachment means comprising stitching and sewing.

2. The invention according to claim 1 in which said at least one roll of said second pair of rolls having a noncontinuous groove-threaded surface comprises a substantially cylindrical roll, said cylindrical roll having fabricated therein a plurality of connected thread teeth positioned along the circumference of said cylindrical roll to form a curvilinear herringbone pattern utilizing a first and second opposing pitch, said thread teeth alternatively drawing bundles of said tow in tension and releasing said bundles relative to contact between said bundles and said teeth and spaces between said teeth respectively, while said tow passes between said second pair of rolls.

3. The invention according to claim 2 in which each of said first and second opposing pitches respectively extends for one-half the circumference of said roll before a successive change in pitch is encountered.

4. The invention according to claim 1 in which the peripheries of each of said second pair of rolls rotate at a velocity substantially between $1\frac{1}{4}$ to 2 times the velocity of the peripheries of each of said first pair of rolls.

5. The invention according to claim 4 in which said peripheral velocity of each of said second pair of rolls ranges from 60 to 120 feet per minute—said velocity of each of said first pair of rolls ranging from 50 to 70 feet per minute.

6. The invention according to claim 1 in which each roll of said first pair of rolls and said second pair of rolls, respectively, meet one another under exerted pressure, said pressure between each of said first pair of rolls being substantially twice the pressure between said second pair of rolls.

7. The invention according to claim 1 in which each roll of said first pair of rolls and said second pair of rolls, respectively, meet one another under exerted pressure, said pressure between each of said first pair of rolls being substantially 60 pounds per square inch, said pressure between each of said second pair of rolls being substantially 30 pounds per square inch.

8. The invention according to claim 1 in which said dispersing and spreading of said tow is accomplished through the steps of:

guiding said tow through a plurality of dispersion devices, each of said dispersion devices utilizing air directed through angularly positioned slits to direct the fibers of said tow outwardly so as to form said substantially dispersed web.

9. The invention according to claim 8 in which one of said dispersing devices is positioned closely proximate to the nip found between said first pair of rolls so as to thereby disperse said web immediately before deregistering of said synthetic tow material, said first and second pairs of rolls being closely positioned to one another to minimize contraction of the two web between said first and second pairs of rolls as said web is opened and deregistered.

10. The invention according to claim 1 in which said dispersing and spreading of said tow is accomplished through the steps of:

guiding said tow into a plurality of dispersion devices, at least one of said dispersion devices comprising a pair of dispersion rolls, each roll of which rotates oppositely to one another, said at least one roll of said pair of dispersion rolls having a noncontinuous groove-threaded surface for further spreading the tow bundle outwardly into a wider configuration.

11. The invention according to claim 1 in which the invention further comprises the steps of:

crimping said sandwiched web and said first and second layers of article surface material together;

attaching said first layer of article surface material to said second layer of article surface material by said material attachment means so as to form said article and to envelope and contain said sandwiched tow web as desired; and cutting the article from said sandwiched web as desired.

* * * * *

UNITED STATES PATENT AND TRADEMARK OFFICE

CERTIFICATE OF CORRECTION

PATENT NO. : 4,179,776

DATED : December 25, 1979

INVENTOR(S) : Harold Wortman

It is certified that error appears in the above-identified patent and that said Letters Patent are hereby corrected as shown below:

| | |
|---|---|
| Column 2, line 58 | Delete "two" and insert instead --tow--. |
| Column 6, line 21 | Delete "two" and insert instead --tow--. |
| Column 6, line 65 | Delete "two" and insert instead --tow--. |
| Column 10, line 55 | Delete "two" and insert instead --tow--. |

Signed and Sealed this

*First* Day of *April 1980*

[SEAL]

*Attest:*

SIDNEY A. DIAMOND

*Attesting Officer*

*Commissioner of Patents and Trademarks*